United States Patent [19]

Pringle

[11] Patent Number: 5,058,682

[45] Date of Patent: Oct. 22, 1991

[54] EQUALIZING MEANS FOR A SUBSURFACE WELL SAFETY VALVE

[75] Inventor: Ronald E. Pringle, Houston, Tex.

[73] Assignee: Camco International Inc., Houston, Tex.

[21] Appl. No.: 574,982

[22] Filed: Aug. 29, 1990

[51] Int. Cl.[5] ..... E21B 34/10; E21B 43/12; F16K 31/163

[52] U.S. Cl. ..... 166/324; 166/332; 166/375

[58] Field of Search ..... 166/324, 375, 374, 332, 166/319; 137/629; 251/58, 63, 63.5

[56] References Cited

U.S. PATENT DOCUMENTS

| | | | |
|---|---|---|---|
| 3,865,141 | 2/1975 | Young | 166/324 X |
| 4,140,153 | 2/1979 | Deaton | 166/324 X |
| 4,376,464 | 3/1983 | Crow | 166/324 |
| 4,621,695 | 11/1986 | Pringle | 166/324 X |
| 4,529,002 | 12/1986 | Pringle | 166/324 |
| 4,676,307 | 6/1987 | Pringle | 166/324 X |
| 4,722,399 | 2/1988 | Pringle | 166/324 |

*Primary Examiner*—Stephen J. Novosad
*Attorney, Agent, or Firm*—Fulbright & Jaworski

[57] ABSTRACT

A subsurface well safety valve for controlling the fluid flow through a well conduit which includes an equalizing line and an equalizing valve in the line. The equalizing line includes a passageway through the interior of the power spring which biases the safety valve to the closed position thereby routing the equalizing line through a simpler and less expensive structure. The equalizing valve is connected to the safety valve flow tube and is movable to a closed position in response to the power spring and is movable to an open position in response to the actuating piston and cylinder assembly.

13 Claims, 3 Drawing Sheets

FIG.1E
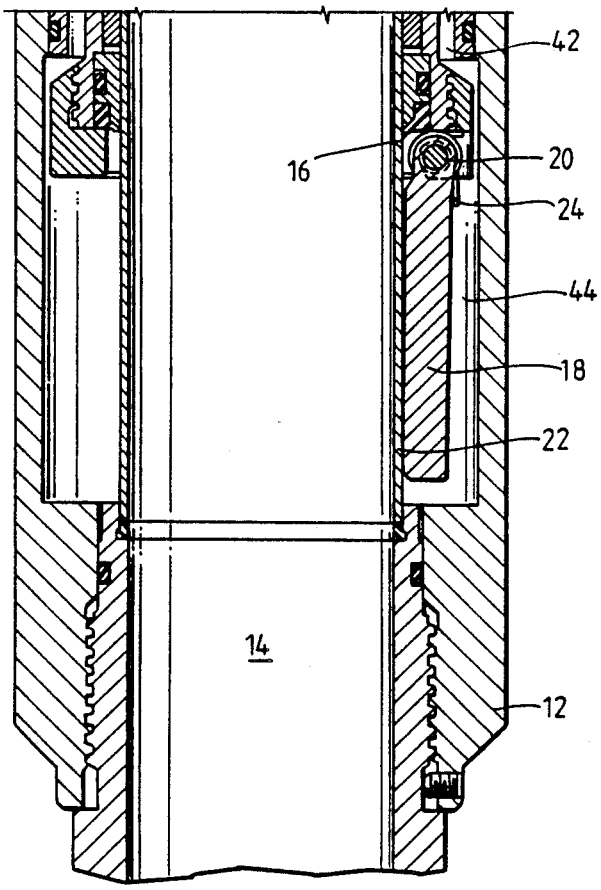
FIG.2
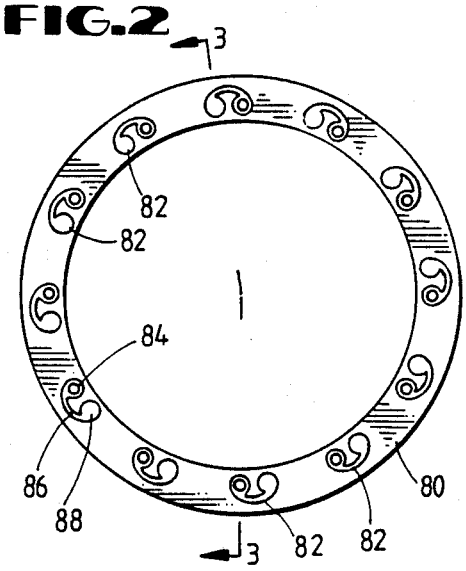
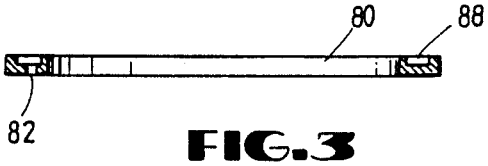
FIG.3
FIG.4
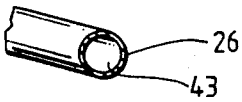
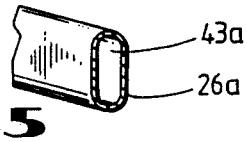
FIG.5
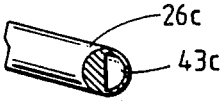
FIG.6

EQUALIZING MEANS FOR A SUBSURFACE WELL SAFETY VALVE

BACKGROUND OF THE INVENTION

It is known, as disclosed in U.S. Pat. Nos. 4,629,002 and 4,722,399 to provide equalizing valves across the valve of a downhole well safety valve That is, the pressure above and below a subsurface safety valve should be equalized prior to opening the safety valve as this protects the main valve. In addition, the equalizing valve itself should be protected from erosion and flow-cutting due to the high pressures and high velocities flowing through the equalizing valve. The above disclosed patents satisfactorily address the problems encountered in equalizing valves, but are complicated, expensive to manufacture, and require additional components both to actuate the equalizing valve and to transfer the required volume of pressurized fluid or gas through an equalizing line from below the main valve to above the main valve.

The present invention provides an equalizing means for use with a subsurface well safety valve which equalizes across the safety valve before returning the valve to the open position and performs this operation and result with fewer parts, an easier-to-manufacture valve, and at less cost. In addition, the present invention has additional features of (1) the capability of transferring a volume of pressurized fluid or gas from below the main valve to above all moving parts in the valve with minimum exposure by routing this fluid/gas through the interior of the safety valve power spring, (2) a new improved series of pressure and velocity reducing chambers is provided in the valve for providing pressure drops for controlling the velocity of the fluid flowing through the equalizing valve, and (3) and the equalizing valve is actuated between an open and closed position by the operating mechanism of the safety valve.

SUMMARY

The present invention is directed to a subsurface well safety valve for controlling the fluid flow through a well conduit which includes a housing having a bore and a valve closure member in the bore moving between open and closed positions for controlling fluid flow through the bore. A flow member is telescopically movable in the housing for controlling the movement of the valve closure member and a piston and cylinder assembly in the housing contacts and moves the flow tube. Spring biasing means are provided in the housing for moving the flow tube in a direction to close the valve. A fluid control port is positioned in the housing in communication with the piston and cylinder assembly, and is adapted to be in communication with fluid pressure at the well surface. An equalizing line is in communication with the bore of the housing between points below and above the valve closure member, and an equalizing valve is provided in the equalizing line. The equalizing line includes a passageway through the interior of the spring biasing means for transferring pressurized fluid or gas from below the valve closure member to above the moving parts in the valve.

A still further object of the present invention is wherein the spring is a helical spring with a circular cross-section and the passageway is circular in cross-section.

Still a further object is wherein the spring means is a helical spring with an oval cross-section and the passageway is oval in cross-section for increasing the area for fluid transfer.

Yet a still further object of the present invention is wherein the spring means is a helical spring with a circular cross-section and the passageway is semicircular in cross-section for providing a spring with greater strength.

Still a further object of the present invention is wherein the equalizing valve moves to the closed position in response to the spring means and moves to the open Position in response to the piston and cylinder assembly.

A still further object to the present invention is wherein the equalizing valve is a spring-loaded poppet valve, and the housing and flow tube include coacting stop shoulders for engagement when the equalizing valve is in the closed position for preventing damaging the poppet valve.

Yet a still further object of the present invention is wherein the equalizing valve is connected to the spring means and the valve includes a valve seat and a valve element. The spring means includes an opening extending from the passageway to the exterior of the spring means and the equalizing line includes an enlarged portion upstream of the valve seat for communicating with the opening for reducing pressure drops.

Yet a still further object of the present invention is wherein pressure and velocity reducing means are positioned in the equalizing line upstream of the spring means and includes a plurality of visco jets.

Other and further objects, feature and advantages will be apparent from the following description of presently preferred embodiments of the invention, given for the purpose of disclosure, and taken in conjunction with the accompanying drawings.

BRIEF DESCRIPTION OF THE DRAWINGS

FIGS. 1A, 1B, 1C, 1D, and 1E are continuations of each other and form a fragmentary elevational view, in cross-section, of a subsurface safety valve utilizing the equalizing means of the present invention, FIG. 2 is a cross-sectional view taken along the line 2—2 of FIG. 1D, FIG. 3 is a cross-sectional view taken along the line 3—3 of FIG. 2, FIG. 4 is a fragmentary cross-sectional view of one form of a power spring biasing means, FIG. 5 is a fragmentary cross-sectional view of another embodiment of a power spring, and FIG. 6 is a fragmentary cross-sectional view of still another power spring.

DESCRIPTION OF THE PREFERRED EMBODIMENT

Figure 1A:
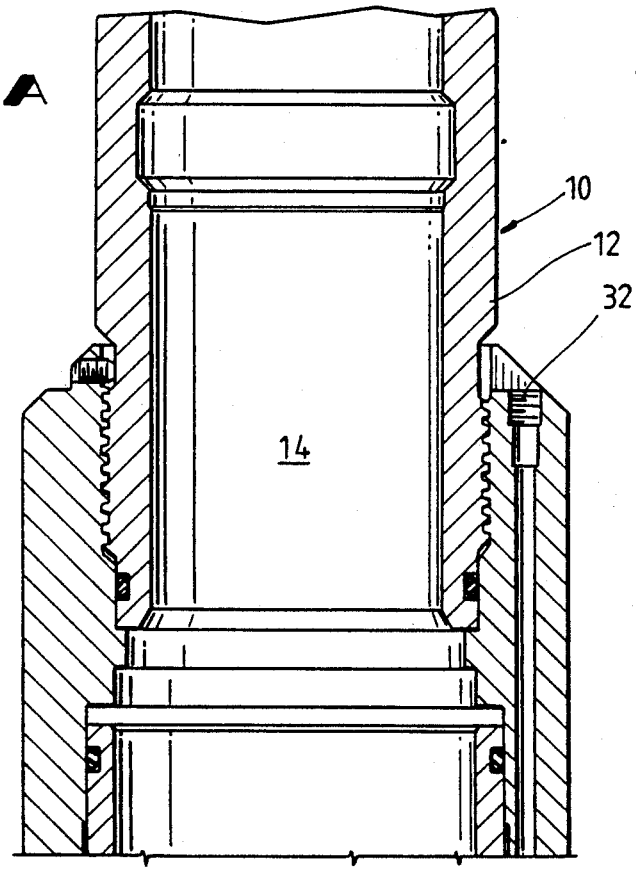

While the present improvement of an equalizing valve system for use in a subsurface safety valve will be described in connection, for purposes of illustration only, as incorporated in a flapper type tubing retrievable safety valve, it will be understood that the present equalizing system may be used with other types of subsurface safety valves.

Referring now to the drawings, and particularly to FIGS. 1A–1E, the subsurface safety valve of the present invention is generally indicated by the reference numeral 10 and is shown as being of a non-retrievable type safety valve for connection in a well conduit or tubing (not shown) such as by threaded ends (not shown) for connecting the safety valve 10 directly into the well tubing of an oil and/or gas well. The safety valve 10 generally includes a body or housing 12 adapted to be connected to a well tubing to permit well production therethrough under normal operating conditions but in which the safety valve 10 may close or be closed in response to abnormal conditions.

The safety valve 10 generally includes a bore 14, an annular valve seat 16 (FIG. 1E), a valve closure element or flapper valve 18 connected to the body 12 by pivot pin 20. A flow tube 22 is telescopically movable in the body 12 and through the valve seat 16 as best seen in FIG. 1E. When the flow tube 22 is moved to a downward position, the tube 22 pushes the flapper 18 away from the valve seat 16. Thus the valve 10 is held in the open position so long as the flow tube 22 is in the downward position. When the flow tube 22 is moved upwardly, the flapper 18 is allowed to move upwardly onto the seat 16 by the action of a spring 24.

Various forces are provided to act upon the flow tube 22 to control the opening and closing of the flapper 18. Thus, biasing means, such as a power spring 26 (FIGS. 1C and 1D), may act between a shoulder 28 on the valve body 12 and a shoulder 30 connected to the flow tube 22 by connection 31 for yieldably urging the flow tube 22 in an upward direction to release the flapper 18 for closing the valve 10. The valve 10 is controlled by the application or removal of a pressurized fluid, such as hydraulic fluid, through a port 32, which is adapted to be connected to a control line extending to the well surface or the casing annulus for supplying a pressurized hydraulic fluid to a piston and cylinder assembly generally indicated by the Reference numeral 34. The assembly 34 may include one or more pistons 36 movable in a cylinder 38 one of which, here shown as a piston 36, contacts or is connected to the flow tube 22, such as by a tongue and groove connection 40 (FIG. 1C). When fluid pressure is applied to the hydraulic assembly 34, the flow tube 22 is moved downwardly forcing the flapper 18 off of the seat 16 and into the full open position as best seen in FIG. 1E. If the fluid pressure in the port 32 is reduced sufficiently relative to the force of the power spring 26 and tubing pressure acting against the hydraulic piston and cylinder assembly 34, the flow tube 22 will be moved upwardly beyond the seat 16 allowing the the valve 10 to close.

Once the valve 10 is closed with the flapper valve 18 seated on the seat 16 it is usual that there is a greater existing pressure in the bore 14 below the flapper 18 than above the flapper 18. This holds the flapper 18 seated with a high differential pressure. It is therefore desirable to equalize the pressure across the flapper 18 before re-opening the valve 10 in order to be able to open the flapper 18 against the differential pressure and to prevent the high velocities of fluid flow through the opening flapper 18 and the valve seat 16 from damaging the flapper 18 and seat 16 by erosion. Therefore, it is conventional to utilize an equalizing line and equalizing valve which is opened prior to opening of the flapper 18 to equalize pressure across the flapper 18.

Figure 1B:
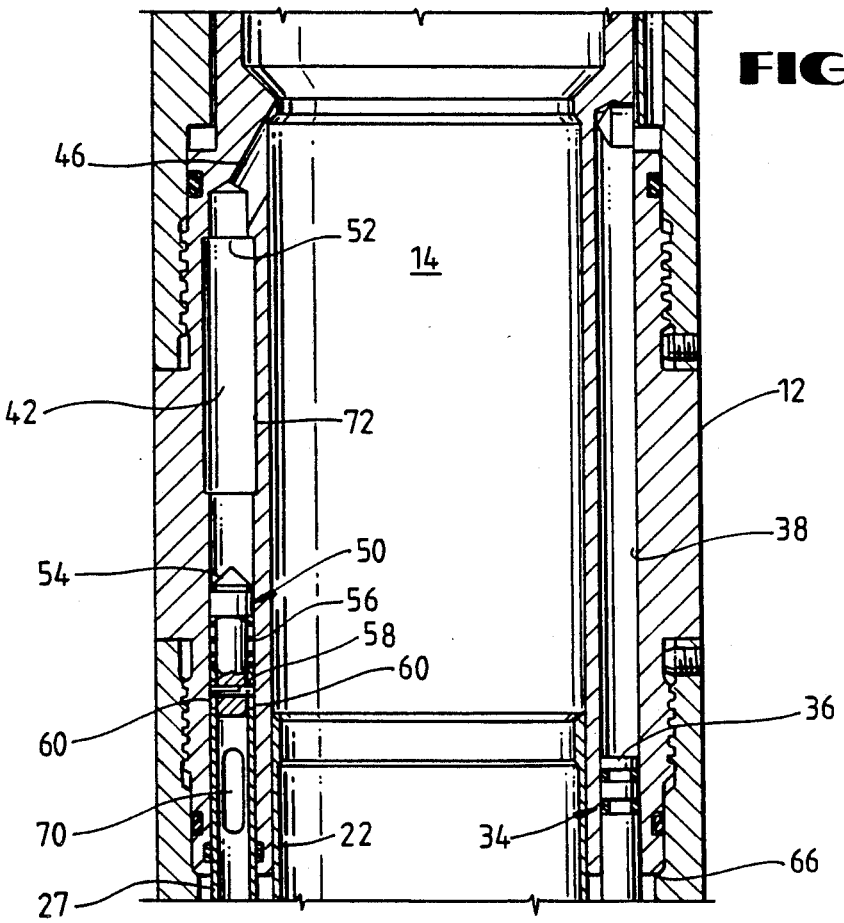
Figure 1C:
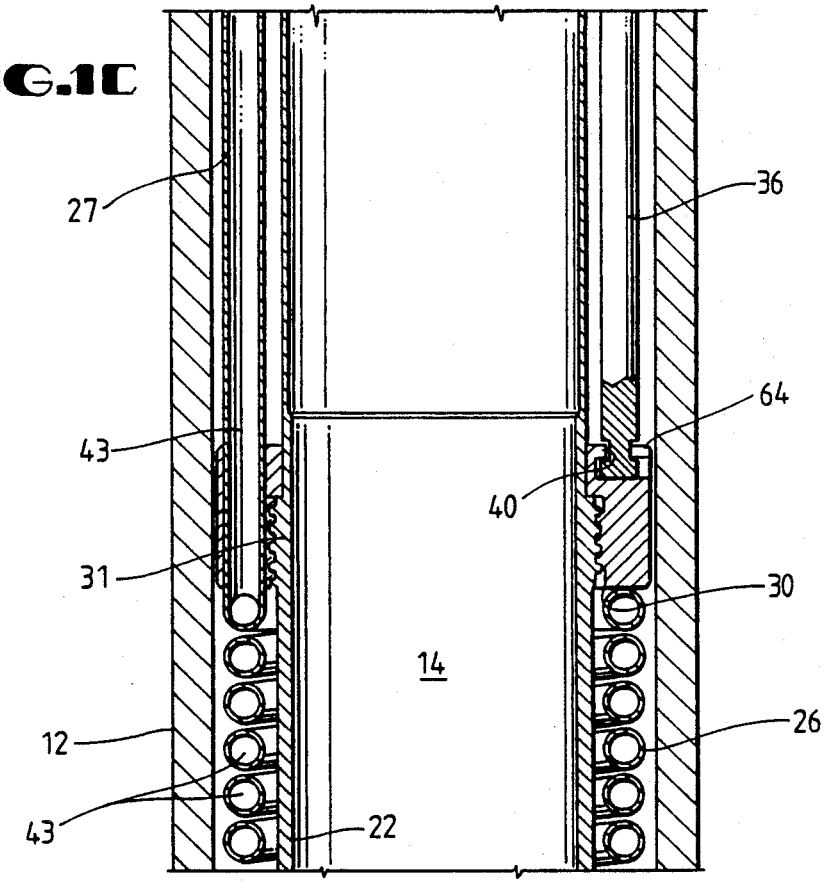
Figure 1D:
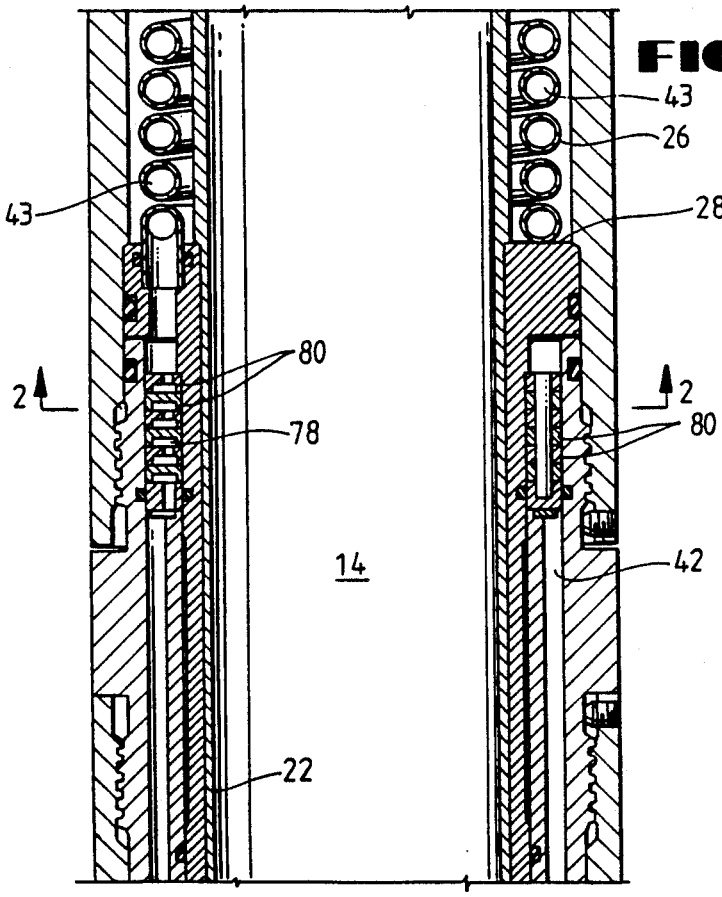

Referring now to FIGS. 1B, 1C, 1D and 1E, an equalizing line 42 is provided in the housing 12 having a lower end 44 in communication with the space below the valve seat 16 and an upper end extending to port 46 (FIG. 1B). Thus, when the equalizing line 42 is open fluid may flow from below the flapper valve 18 (when the flapper 18 is in the closed position) and through the port 46 and into the bore 14 above the flapper 18.

It is to particularly noted that the equalizing line 42 includes a passageway 43 through the interior of the power spring 26. The use of the power spring 26 with an interior passageway 43 therethrough provides a structure for transmitting a volume of pressurized fluid or gas from below the flapper valve 18 to above all of the moving parts in the valve 10 with a minimum exposure to provide a valve which is easier to manufacture, with fewer parts and less cost than prior art valves with their conventional equalizing line passageways.

The present equalizing valve generally indicated by the reference numeral 50 is provided in the equalizing line 42 and consists of a valve seat 52 and a valve element 54. When the valve element 54 is seated on the seat 52 the equalizing line 42 is closed. It is to be noted that the equalizing valve element 54 is connected to the end 27 of the power spring 26 and consequently is also connected to the flow tube 22 through the connection 31 and also connected to the piston 36 through the tongue and grove connection 40 to the connector 31.

Another feature of the present invention is that the valve 50 is actuated by the operating mechanism of the valve 10 and does not require other actuating mechanisms. That is, when hydraulic pressure is released from the piston and cylinder assembly 34 the power spring 26 biases the flow tube 22 upwardly and moves the valve element 54 to seat onto the valve seat 52 whereby the equalizing valve 50 closes the equalizing line 42. On the other hand, when hydraulic fluid is applied against the hydraulic piston and cylinder assembly 34, the piston 36 moves downwardly carrying the flow tube 22 and compressing the power spring 26 and moving the valve element 52 of the equalizing valve 50 away from the valve seat 52 thereby opening the equalizing line 42 to allow pressure across the closed flapper 18 to be equalized. The equalizing valve 50 moves to a closed position in response to the power spring 26 and moves to the open position in response to the movement of the piston and cylinder assembly 34.

It is noted that the equalizing valve 50 is a spring loaded poppet valve having a spring 56 yieldably urging the valve element 54 towards the seat 52. The valve element 54 is longitudinally movable in the end 27 of the spring 26 by means of a pin 58 having limited longitudinal movement in slots 60 in the end 27. Coacting stop shoulder 64 on the flow tube connector 31 and stop shoulder 66 on the housing 12 engage when the equalizing valve 50 comes into the closed position for preventing damaging of the poppet valve 50 by the action of the power spring 26. In addition, the spring 56 also acts to cushion the closing force of the valve element 54 against the valve seat 52.

Preferably, the end 27 of the power spring includes an opening 70 from the inside passageway 43 to the exterior of the end 27 and the equalizing line 42 includes an enlarged section 72 adjacent but upstream of the valve seat 52. Thus, when the equalizing valve 50 starts to open and the element 54 moves away from the valve seat 52, gas may flow through the equalizing line, the enlarged portion 72 and the opening 70, without creating undue pressure drops.

It is also noted that the enlarged portion 72 is therefore larger than the diameter of the valve element 54 causing the valve element 54 to float to some extent in the equalizing line portion 72. Therefore, the end of the valve element 54 is tapered to allow it to align with and seat firmly and securely on the valve seat 52.

Preferably the equalizing line 42 includes a labyrinth passageway 78 for creating control pressure drops along the equalizing line 42 to reduce the pressure and flow velocity through the equalizing line 42 to minimize the flow cutting and erosion of the equalizing valve element 54 and seat 52 thereby increasing the life of the equalizing valve 50. While the labyrinth passageway may be of any suitable undultory passageway which offers resistance to fluid flow, preferably a plurality of visco jet plates 80 (FIGS. 2, 3, and 4) are provided in that they are advantageous over the prior labyrinth passageways in that they can perform the function of controlling the pressure drop and velocities through the equalizing line 42 in a shorter distance than other types of labyrinth passageways. Such a reduction in the axial extent of the labyrinth passageway 78 reduces the overall length of the safety valve 10 and again reduces its expense.

The visco jets 80 include a plurality of fluid passageways generally indicated by the reference numeral 82 wherein each passageway 82 includes an entering orifice 84 for receiving fluid which then flows through a tangential slot 86 and into a spin chamber 88 and discharges into a small center hole in the next adjacent jet plate 80. This structure is similar to visco jets sold under the trademark "LEE VISCO JETS". If for some reason, the safety valve 10 is used in an oil well having a considerable amount of sand in the well production and low well pressures, the visco jets 80 may be omitted and the valve operated without the labrinth passageway 78. On the other hand, if the oil production is relatively free of sand and is of higher pressures, additional visco jet plates 80 may be added to decrease the pressure and flow velocity through the equalizing line 42.

Another advantage of using the visco jet plates 80 is that various types of materials can be used which are not as subject to erosion. For instance, ceramic discs or iron-coated discs with titanium nitride may be used as the discs 80 are not required to hold pressure, but merely to be in the path of flowing well production. Preferably, the visco jet discs 80 are lapped so that the adjacent members provide a coacting face seal to require all of the well production to flow through the jets 82 instead of bypassing the discs.

Referring now to FIG. 4, it is noted that the spring 26 is preferably circular in cross section and the passageway 43 therein is also circular in cross section. However, other and further embodiments of the spring and passageway may be provided if desired.

Referring now to FIG. 5, the helical spring **26*a* is oval in cross section, and the passageway 43*a* therein is also oval in cross section. This configuration provides a larger flow area for fluid flow through the spring 26*a* in comparison with the spring 26. However, with the use of the oval spring 26*a*, the spring 26*a* will increase the spring rate and thus the opening-closing pressure differential with the result that the number of coils will have to be increased. Referring now to FIG. 6, the helical spring 26*c* is circular in cross section but the passageway 43*c* is semi-circular in cross section. While the configuration noted in FIG. 6 will decrease the flow area and cause the equalization time to increase, the spring 26*c* will have greater strength, a decrease spring rate and thus fewer number of coils than the springs 26 and 26*a***.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts may be made without departing from the spirit of the invention and the scope of the appended claims.

What is claimed is:

1. A subsurface well safety valve for controlling the fluid flow through a well conduit comprising, a housing having a bore and a valve closure member in the bore moving between open and closed positions for controlling fluid flow through the bore, a flow tube telescopically movable in the housing for controlling the movement of the valve closure member, a piston and a cylinder assembly in the housing contacting and moving the flow tube, spring biasing means in the housing for moving the flow tube in a direction to close the valve, a fluid control port positioned in the housing in communication with the piston and cylinder assembly and adapted to be in communication with fluid pressure at the well surface, an equalizing line in communication with the bore of the housing between points below and above the valve closure member, an equalizing valve in the equalizing line, and said equalizing line includes a passageway through the interior of the spring biasing means.

2. The apparatus of claim 1 wherein, the spring means is a helical spring with a circular cross-section and said passageway is circular in cross-section.

3. The apparatus of claim 1 wherein, the spring means is a helical spring with an oval cross-section and said passageway is oval in cross-section.

4. The apparatus of claim 1 wherein, the spring means is a helical spring with a circular cross-section and said passageway is semicircular in cross-section.

5. The apparatus of claim 1 wherein, the equalizing valve is connected to the spring means.

6. The apparatus of claim 1 wherein, the equalizing valve, moves to the closed position in response to the spring means and, moves to the open position in response to the piston and cylinder assembly.

7. The apparatus of claim 1 wherein, the equalizing valve is a spring loaded poppet valve, and said housing and flow tube include coacting stop shoulders for engagement when the equalizing valve is in the closed position for preventing damaging the poppet valve.

8. The apparatus of claim 1 wherein, the equalizing valve is connected to the spring means, and said equalizing valve includes a valve seat and a valve element, said spring means includes an opening extending from the passageway to the exterior of the spring means, and said equalizing line includes an enlarged portion upstream of the valve seat for communicating with the opening for reducing pressure drops.

9. The apparatus of claim 1 including, pressure and velocity reducing means positioned in the equalizing line upstream of the spring means.

10. The apparatus of claim 9 wherein, the pressure and velocity reducing means included a plurality of visco jets.

11. A subsurface well safety valve for controlling the fluid flow through a well conduit comprising, a housing having a bore and a valve closure member in the bore moving between open and closed positions for controlling fluid flow through the bore, a flow tube telescopically movable in the housing for controlling the movement of the valve closure member, a piston and cylinder assembly in the housing contacting and moving the flow tube, spring biasing means in the housing for moving the flow tube in a direction to close the valve, a fluid control port positioned in the housing in communication with the piston and cylinder assembly and adapted to be in communication with fluid pressure at the well surface, an equalizing line in communication with the bore of the housing between points below and above the valve closure member, an equalizing valve in the equalizing line, and said equalizing valve connected to flow tube and movable to the closed position in response to the spring biasing means and movable to the open position in response to the piston and cylinder assembly.

12. The apparatus of claim 11 wherein, said equalizing line includes a passageway through the interior of the spring means.

13. The apparatus of claim 12 including, a plurality of visco jets positioned in the equalizing line upstream of the equalizing valve.

* * * * *